US009372440B2

(12) United States Patent
Furuta et al.

(10) Patent No.: US 9,372,440 B2
(45) Date of Patent: Jun. 21, 2016

(54) DEVELOPING DEVICE AND IMAGE FORMING APPARATUS

(71) Applicant: Konica Minolta, Inc., Tokyo (JP)

(72) Inventors: Tatsuya Furuta, Tokyo (JP); Tomohiro Kawasaki, Kanagawa (JP); Kazuteru Ishizuka, Saitama (JP); Kazuhiro Saito, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/287,785

(22) Filed: May 27, 2014

(65) Prior Publication Data

US 2014/0369718 A1 Dec. 18, 2014

(30) Foreign Application Priority Data

Jun. 12, 2013 (JP) ..... 2013-123827

(51) Int. Cl.
*G03G 15/09* (2006.01)
*G03G 15/08* (2006.01)

(52) U.S. Cl.
CPC ..... *G03G 15/0868* (2013.01); *G03G 15/0849* (2013.01); *G03G 15/0822* (2013.01); *G03G 15/0832* (2013.01); *G03G 15/0893* (2013.01); *G03G 15/09* (2013.01); *G03G 2215/0607* (2013.01); *G03G 2215/0609* (2013.01)

(58) Field of Classification Search
CPC ..... G03G 15/09
USPC ..... 399/259
See application file for complete search history.

(56) References Cited

U.S. PATENT DOCUMENTS

| | | | | |
|---|---|---|---|---|
| 6,006,050 | A * | 12/1999 | Watanabe et al. | 399/58 |
| 6,466,749 | B1 * | 10/2002 | O'Brien | 399/27 |
| 6,587,661 | B1 * | 7/2003 | Shimmura et al. | 399/257 |
| 7,254,348 | B2 | 8/2007 | Yahagi | |
| 8,897,680 | B2 * | 11/2014 | Ooishi et al. | 399/260 |
| 2005/0220463 | A1 | 10/2005 | Yahagi | |
| 2009/0162102 | A1 * | 6/2009 | Wayman | 399/259 |
| 2009/0245879 | A1 * | 10/2009 | Minami et al. | 399/255 |
| 2009/0290886 | A1 * | 11/2009 | Murauchi et al. | 399/27 |
| 2009/0290887 | A1 * | 11/2009 | Murauchi et al. | 399/27 |
| 2009/0310984 | A1 * | 12/2009 | Sakatani et al. | 399/30 |
| 2009/0310985 | A1 * | 12/2009 | Hirata et al. | 399/30 |
| 2010/0215406 | A1 * | 8/2010 | Ozawa | 399/257 |
| 2014/0205327 | A1 * | 7/2014 | Nakamura et al. | 399/258 |
| 2014/0369718 | A1 * | 12/2014 | Furuta et al. | 399/259 |

FOREIGN PATENT DOCUMENTS

JP 2005-292376 A 10/2005

* cited by examiner

*Primary Examiner* — Clayton E Laballe
*Assistant Examiner* — Kevin Butler
(74) *Attorney, Agent, or Firm* — Cantor Colburn LLP

(57) ABSTRACT

A developing device includes: a developer container section configured to contain therein a two-component developer composed of toner and magnetic carrier; a developer bearing member configured to supply the developer to an image bearing member on which an electrostatic latent image is formed; a toner supplying section configured to supply the toner to the developer container section via the toner supply port; a carrier supplying section provided separately from the toner supplying section, the carrier supplying section being configured to supply the carrier to the developer container section via the carrier supply port; and a carrier detection section disposed at a position near the carrier supply port and at a same level as a powder surface of the developer contained in the developer container section, the carrier detection section being configured to detect carrier supplied from the carrier supplying section.

12 Claims, 10 Drawing Sheets

DEVELOPING DEVICE AND IMAGE FORMING APPARATUS

CROSS REFERENCE TO RELATED APPLICATIONS

This application is entitled to and claims the benefit of Japanese Patent Application No. 2013-123827, filed on Jun. 12, 2013, the disclosure of which including the specification, drawings and abstract is incorporated herein by reference in its entirety.

BACKGROUND OF THE INVENTION

1. Field of the Invention

The present invention relates to a trickle-development type developing device which uses a two-component developer and an image forming apparatus which includes the developing device.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner to the photoconductor (image carrier) on which the electrostatic latent image is formed, whereby a toner image is formed. Further, the toner image is directly or indirectly transferred to a sheet through an intermediate transfer belt, followed by heating and pressurization for fixing, whereby an image is formed on the sheet.

Development methods for forming a toner image on a photoconductor include the one-component development method which uses only toner as the main component of a developer, and the two-component development method which uses toner and carrier as the main components of a developer. In the two-component development method, toner and carrier are mixed and stirred to frictionally charge the toner. Ideally, to stably charge the toner, the surface of the carrier does not change.

In a two-component development type developing device, toner is consumed in a development process, while carrier is not consumed and left in the developing device. Therefore, the carrier accumulates mechanical stress and thermal stress due to the contact with the toner, and the surface of the carrier is contaminated by the attachment of the toner. Under such circumstances, the trickle-development method has been widely used in which carrier is periodically replaced by outputting the developer (developer to be discarded) containing degraded carrier while newly supplying a developer (toner and carrier).

In such a two-component development type developing device, for example, the toner concentration (the ratio of the toner to the total amount of the developer) in a developer container is determined by a toner concentration sensor, and toner is supplied so that the toner concentration falls within a desired concentration range, that is, toner is supplied in accordance with a toner consumption amount (see, for example, Japanese Patent Application Laid-Open No. 2005-292376 (Patent Document 1)). In Patent Document 1, an operation for supplying a developer in which toner and carrier are mixed at a certain ratio is controlled on the basis of the toner concentration. Typically, the toner concentration sensor is provided at a remote position on the downstream side relative to a developer supply port in the developer conveyance direction, and near a bottom of a developer container in order to detect the toner concentration in a stable state in which toner and carrier are sufficiently stirred.

On the other hand, in the case where carrier is supplied together with toner in accordance with the toner consumption amount, the following problems may be caused. Specifically, when the toner consumption amount is large, even non-degraded carrier is replaced, and thus the carrier is wastefully discarded. When the toner consumption amount is small, the degraded carrier is used without being replaced. As a result, the charging performance is degraded, degrading the image quality. Under such circumstances, there is a developing device in which a toner supplying section and a carrier supplying section are separately provided, and toner is supplied on the basis of the toner concentration, while carrier is periodically supplied at predetermined time intervals.

In the case where carrier is supplied together with toner as is the case of the developing device disclosed in Patent Document 1, whether an operation for supplying developer has been normally performed can be determined on the basis of results of detection obtained by the toner concentration sensor. However, in the case where toner and carrier are separately supplied, it is difficult to detect by the toner concentration sensor whether the carrier supplying operation has been normally carried out. The reason for this is that, typically, the amount of carrier which is supplied by the carrier supplying operation is small, and the carrier concentration (100-toner concentration[%]) is not substantially changed in a stable state where toner and carrier have been sufficiently stirred.

Therefore, when carrier is not normally supplied and the supply of carrier is stopped, the degradation of carrier is facilitated in the developer container and the amount of the carrier becomes insufficient, and consequently, the image quality may be degraded due to fogging, toner scattering and the like.

SUMMARY OF THE INVENTION

An object of the present invention is to provide a developing device and an image forming apparatus which can surely determine whether a carrier supplying operation, which is performed separately from a toner supplying operation, has been performed, and can prevent degradation in image quality due to degradation of carrier.

To achieve the abovementioned object, a developing device reflecting one aspect of the present invention includes: a developer container section including a toner supply port, a carrier supply port, and a developer outlet, the developer container section being configured to contain therein a two-component developer composed of toner and magnetic carrier; a developer bearing member configured to supply the developer contained in the developer container section to an image bearing member on which an electrostatic latent image is formed; a toner supplying section configured to supply the toner to the developer container section via the toner supply port; a carrier supplying section provided separately from the toner supplying section, the carrier supplying section being configured to supply the carrier to the developer container section via the carrier supply port; and a carrier detection section disposed at a position near the carrier supply port and at a same level as a powder surface of the developer contained in the developer container section, the carrier detection section being configured to detect carrier supplied from the carrier supplying section.

An image forming apparatus reflecting one aspect of the present invention includes the developing device, wherein the developing device forms a toner image on the image bearing member, and, after the toner image thus formed is transferred to a sheet, fixing is performed to form an image.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, an embodiment of the present invention will be described in detail with reference to the accompanying drawings.

Figure 1:
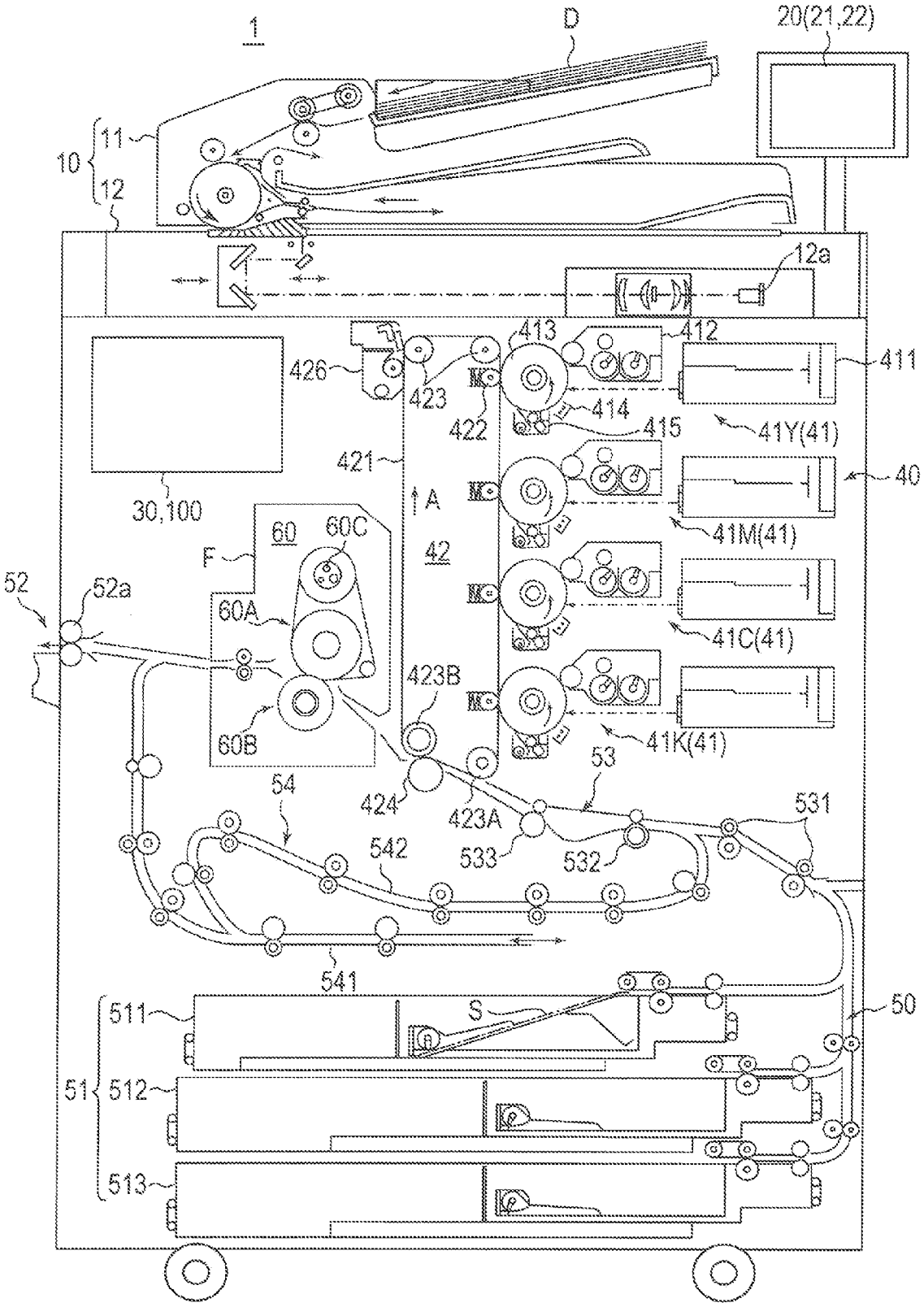
FIG. 1 illustrates a general configuration of an image forming apparatus according to an embodiment of the present invention.

FIG. 1 illustrates a general configuration of image forming apparatus 1 according to an embodiment of the present invention.

Image forming apparatus 1 illustrated in FIG. 1 is a color-image forming apparatus with an intermediate transfer system using electrophotographic process technology. A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to a sheet, to thereby form an image.

As illustrated in FIG. 1, image forming apparatus 1 includes image reading section 10, operation display section 20, image processing section 30, image forming section 40, sheet conveyance section 50, fixing section 60, and control section 100.

Control section 100 includes central processing unit (CPU), read only memory (ROM), random access memory (RAM) and the like. CPU reads a program suited to processing contents out of ROM, develops the program in RAM, and integrally controls an operation of each block of image forming apparatus 1 in cooperation with the developed program. At this time, CPU refers to various kinds of data stored in a storage section (not illustrated). The storage section (not illustrated) is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) and a wide area network (WAN), through a communication section (not illustrated). Control section 100 receives, for example, image data transmitted from the external apparatus, and performs control to form an image on a sheet on the basis of the image data (input image data). A communication section (not illustrated) is composed of, for example, a communication control card such as a LAN card.

Image reading section 10 includes auto document feeder (ADF) 11, document image scanner 12, and the like.

Auto document feeder 11 causes a conveyance mechanism to feed a document placed on a document tray, and sends out the document to document image scanner 12. Auto document feeder 11 enables images (even both sides thereof) of a large number of documents placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

Image processing section 30 includes a circuit that performs digital image processing suited to initial settings or user settings, on the input image data, and the like. For example, image processing section 30 performs toner correction on the basis of toner correction data (toner correction table), under the control of control section 100. In addition to the toner correction, image processing section 30 also performs various correction processes such as color correction and shading correction as well as a compression process, on the input image data.

Image forming section 40 is controlled on the basis of the image data that has been subjected to these processes.

Image forming section 40 includes: image forming units 41 for images of colored toners respectively containing a Y component, an M component, a C component, and a K component on the basis of the input image data; intermediate transfer unit 42; and the like. A writing range within which an image is formed by image forming section 40 is set in advance.

Image forming unit 41 includes image forming units 41Y, 41M, 41C, and 41K for the Y component, the M component, the C component, and the K component. Image forming units 41Y, 41M, 41C, and 41K have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415, and the like.

Photoconductor drum 413 is, for example, a negatively-charged-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum.

The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 414 is composed of, for example, a corona discharging generator such as a scorotron charging device and a corotron charging device. Charging device 414 negatively charges the surface of photoconductor drum 413 in a uniform manner by corona discharging.

Exposure device 411 is composed of, for example, a semiconductor laser. Exposure device 411 irradiates photoconductor drum 413 with laser light corresponding to images of the color components. The positive charge which is generated in the charge generation layer of photoconductor drum 413 is transported to the surface of the charge transport layer, and thus the surface charge (negative charge) of photoconductor drum 413 is neutralized. As a result, by the potential difference relative to the surroundings, electrostatic latent images of the color components are formed on the surface of photoconductor drum 413.

Developing device 412 stores therein developers of respective color components (for example, two-component developers composed of toner having a small particle size and a magnetic material). Developing device 412 attaches the toners of respective color components to the surface of photoconductor drum 413, and thus visualizes the electrostatic latent image to form a toner image. To be more specific, a developing bias voltage is applied to a developer bearing member, and the charged toner on the developer bearing member is caused to move and attach to an exposed portion on the surface of photoconductor drum 413 by the potential difference between the surface of photoconductor drum 413 and the developer bearing member. Developing device 412 will be described in detail later.

Drum cleaning device 415 includes, for example, a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426, and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily kept at a constant speed. When driving roller 423A rotates, intermediate transfer belt 421 travels in an arrow A direction at a constant speed.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face roller 423B (hereinafter referred to as "backup roller 423B") disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to a sheet is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when a sheet passes through the secondary transfer nip, the toner image on intermediate transfer belt 421 is secondary-transferred to the sheet. To be more specific, a secondary transfer bias is applied to secondary transfer roller 424, and electric charge of the polarity opposite to the polarity of the toner is applied to the rear side (the side that makes contact with secondary transfer roller 424) of the sheet, whereby the toner image is electrostatically transferred to the sheet. The sheet on which the toner image has been transferred is conveyed toward fixing section 60.

Belt cleaning device 426 includes, for example, a belt cleaning blade that is brought into sliding contact with the surface of intermediate transfer belt 421, and removes residual toner that remains on the surface of intermediate transfer belt 421 after the secondary transfer.

It is to be noted that, in intermediate transfer unit 42, a component (so-called belt-type secondary transfer unit) in which a secondary transfer belt is installed in a stretched state in a loop form around a plurality of support rollers including a secondary transfer roller may be employed in place of secondary transfer roller 424.

Fixing section 60 includes upper fixing section 60A having a fixing side member disposed on a fixing surface (the surface on which a toner image is formed) side of a sheet, lower fixing section 60B having a back side supporting member disposed on the rear surface (the surface opposite to the fixing surface) side of a sheet, heating source 60C, and the like.

When upper side fixing section 60A is of a belt heating type (see FIG. 1), the fixing belt serves as the fixing side member, and when upper side fixing section 60A is of a roller heating type, the fixing roller serves as the fixing side member. In addition, when lower side fixing section 60B is of a roller pressing type (see FIG. 1), the pressure roller serves as the back side supporting member, and when lower side fixing section 60B is of a belt pressing type, the pressing belt serves as the back side supporting member. The back side supporting member is brought into pressure contact with the fixing side member, whereby a fixing nip for conveying a sheet in a tightly sandwiching manner is formed.

Fixing section 60 applies, at the fixing nip, heat and pressure to a sheet on which a toner image has been secondary-transferred, thereby fixing the toner image on the sheet. Fixing section 60 is disposed as a unit in fixing device F. In addition, fixing device F may be provided with an air-separating unit that blows air to separate a sheet from the fixing side member or the back side supporting member. Fixing section 60 will be described in detail later.

Sheet conveyance section 50 includes sheet feeding section 51, ejection section 52, first conveyance section 53, second conveyance section 54, and the like.

Three sheet feed tray units 511 to 513 included in sheet feeding section 51 store therein sheets (standard sheets, special sheets) discriminated on the basis of the basis weight, the size, and the like, for each type set in advance.

First conveyance section 53 has a plurality of conveyance roller sections including intermediate conveyance roller sections 531, loop roller section 532, and registration roller section 533. First conveyance section 53 conveys a sheet fed from sheet feeding section 51, or external sheet feeder (not illustrated) to image forming section 40 (secondary transfer section).

Second conveyance section 54 includes back side conveyance path 542 and switchback path 541 in which a plurality of conveyance roller sections are disposed. Second conveyance section 54 once conveys the sheet to switchback path 541, and then performs a switchback to convey the sheet to back side conveyance path 542, thus inverting the sheet. Thereafter, second conveyance section 54 feeds the sheet to first conveyance section 53 (the upstream of loop roller section 532).

The sheet fed from sheet feeding section 51 or an external sheet feeder (not illustrated) is conveyed to image forming section 40 by first conveyance section 53. When the sheet passes through the second transfer nip, a toner image on intermediate transfer belt 421 is secondary-transferred to one side (surface) of the sheet at one time, and then a fixing process is performed in fixing section 60. The sheet on which the image has been formed is ejected out of the image forming apparatus by ejection section 52 including sheet ejection roller 52*a*.

Figure 2:
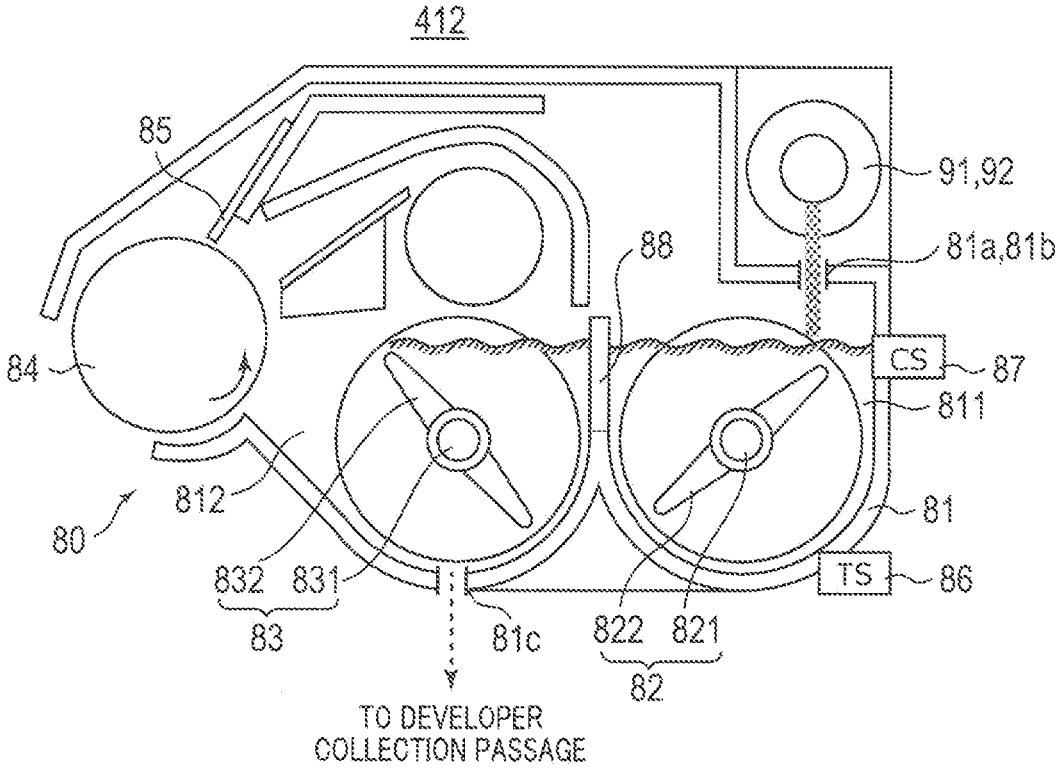
FIG. 2 illustrates an exemplary configuration of a developing device according to the embodiment.
Figure 3:
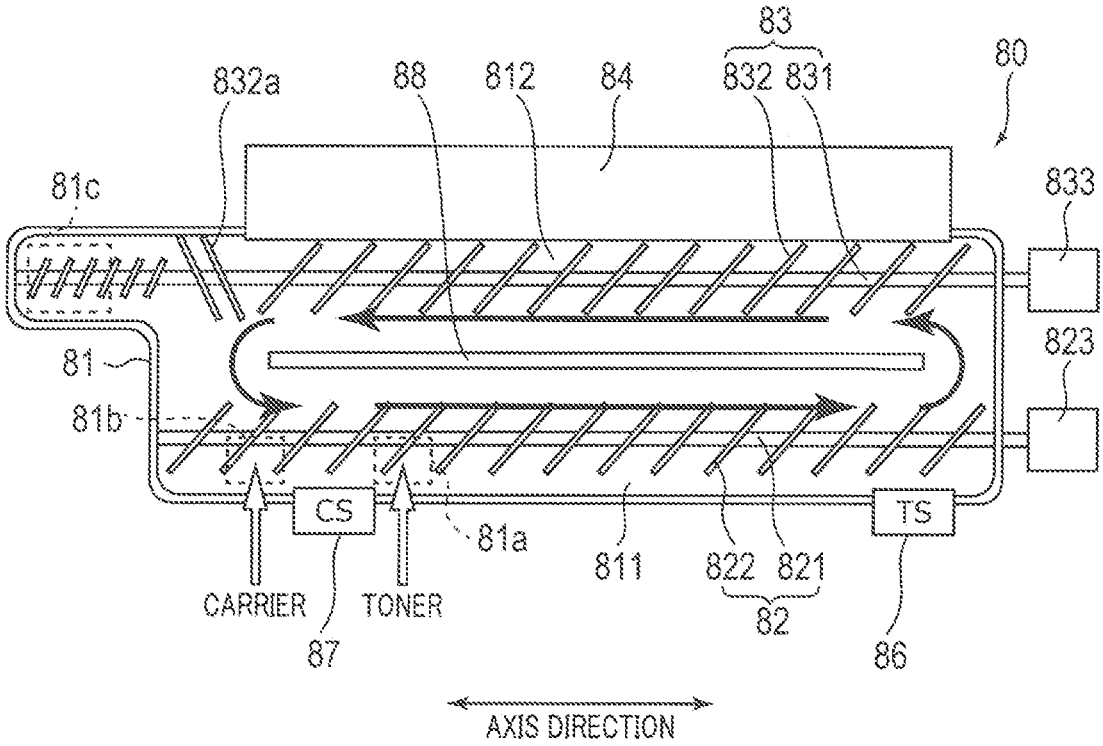
FIG. 3 illustrates an internal configuration of a developing device body.

FIG. 2 illustrates an exemplary configuration of developing device 412 according to the embodiment. FIG. 3 illustrates an internal configuration of developing device body 80.

As illustrated in FIG. 2, developing device 412 includes developing device body 80, toner supplying section 91 that supplies toner to developing device body 80, and carrier supplying section 92 that supplies carrier to developing device body 80.

Developing device 412 is of a trickle-development type in which toner is supplied for the toner consumed by the image formation, and the carrier in developer container 81 is replaced little by little. The trickle mechanism may be of a conventional circulation-overflow type or liquid-surface overflow type. With such a configuration, degraded carrier is replaced by newly supplied carrier, whereby the toner in developer container 81 is always evenly charged. Consequently, the image quality can be maintained regardless of the number of sheets to be printed and environmental change.

Developing device body 80 includes developer container 81, stirring screw 82, supplying screw 83, developing roller 84, developer restriction member 85, toner concentration sensor 86, carrier detection sensor 87, and the like.

Developer container 81 contains therein a two-component developer composed of toner and carrier. Partition wall 88 partitions the inside of developer container 81 into developer stirring path 811 and developer supplying path 812 which extend in parallel to the axis direction of developing roller 84. Developer stirring path 811 and developer supplying path 812 are in communication with each other at both end portions in the axis direction so that the developer is conveyed in a circulating manner. That is, the developer conveyance direction in developer stirring path 811 and that in developer supplying path 812 are opposite to each other.

Above developer stirring path 811, developer container 81 includes toner supply port 81*a* for supplying toner, and carrier supply port 81*b* for supplying carrier. In FIG. 3, carrier supply port 81*b* is disposed on the upstream side in the developer conveyance direction, relative to toner supply port 81*a*.

The toner output from toner supplying section 91 is supplied to developing device body 80 via toner supply port 81*a*, and the carrier output from carrier supplying section 92 is supplied to developing device body 80 via carrier supply port 81*b*. Control section 100 controls an operation for supplying toner of toner supplying section 91 and a carrier supplying operation of supplying section 92.

In developer stirring path 811, stirring screw 82 is disposed along the axis direction. Stirring screw 82 has a configuration in which vane 822 is spirally formed at a predetermined pitch over almost the entire length of shaft 821 which is connected with drive motor 823. When stirring screw 82 rotates, the developer is conveyed in one direction (in FIG. 3, left to right) while being stirred.

In developer supplying path 812, supplying screw 83 is disposed along the axis direction. Supplying screw 83 has the same configuration as that of stirring screw 82, that is, has a configuration in which vane 832 is spirally formed at a predetermined pitch over almost the entire length of shaft 831 which is connected with drive motor 833. It is to be noted that vane 832*a* which is provided near a communication section connecting developer supplying path 812 to developer stirring path 811 is formed in an inverted spiral form in order to circulate the developer to developer stirring path 811. When supplying screw 83 rotates, the toner and carrier are conveyed in one direction (in FIG. 3, right to left) while being stirred.

When the developer is conveyed in developer stirring path 811 and developer supplying path 812, the toner and carrier contained in the developer are brought into frictional contact with each other, and are charged in opposite polarities. In this example, the carrier is positively charged, and the toner is negatively charged.

Mainly by electrical attraction, the negatively charged toner attaches to the outer surface of the positively charged carrier. In the course of being conveyed in developer supplying path 812, the developer is supplied to developing roller 84.

Developing roller 84 supplies the developer to photoconductor drum 413 on which electrostatic latent image is formed. Developing roller 84 is a so-called magnet roller provided with a magnet (not illustrated) which is non-rotatably fixed thereto, and a cylindrical conveyance sleeve (not illustrated) which is rotatably disposed around the magnet, for example.

Substantially upwardly of developing roller 84, developer restriction member 85 is disposed so as to face developing roller 84 with a predetermined distance therebetween. Developer restriction member 85 is a plate-shaped member made of a magnetic substance such as stainless steel, and extends in parallel with developing roller 84.

The magnet of developing roller 84 has plural magnetic poles. These magnetic poles form a magnetic field (line of magnetic force) for conveying the developer by the conveyance sleeve.

The developer supplied to the conveyance sleeve is napped along the line of magnetic force formed by the magnet, thus forming a so-called magnetic brush. The developer is conveyed counterclockwise along with the rotation of the conveyance sleeve, and passed through the gap between itself and developer restriction member 85 such that the thickness thereof is limited to a constant thickness.

The toner borne on the conveyance sleeve is supplied to photoconductor drum 413, whereby the electrostatic latent image on photoconductor drum 413 is developed.

Toner concentration sensor 86 determines the toner concentration (the ratio [%] of the toner to the total amount of the developer) in developer container 81. Toner concentration sensor 86 is disposed in a region where toner and carrier are sufficiently mixed by stirring (in this example, at the bottom section of the container on the downstream side in the conveyance direction, in developer stirring path 811). With toner concentration sensor 86, it is also possible to determine the carrier concentration (100-toner concentration[%]).

For example, a permeability sensor that determines the permeability of the developer may be applied as toner concentration sensor 86. There is a correlation between the permeability of the developer and the toner concentration of the developer, and therefore it is possible to determine the toner concentration of the developer on the basis of the output voltage value which indicates the permeability of toner concentration sensor 86. Alternatively, an optical sensor may be applied as toner concentration sensor 86.

Control section 100 determines whether the amount of the toner remaining in developer container 81 is proper on the basis of the output voltage value from toner concentration sensor 86. When the amount of the remaining toner is small, control section 100 requests toner supplying section 91 to supply toner to developing device body 80.

A surplus developer (developer to be discarded) resulting from the supply of toner from toner supplying section 91 is output to a developer collection passage (not illustrated) from developer outlet 81*c* provided at an end portion in the axis direction of the developer supplying path of developing device body 80. Developer outlet 81*c* is provided at the most downstream position in the developer conveyance direction of developer supplying path 812 so that the carrier supplied from carrier supplying section 92 is not output instantly.

The above-described configuration of developing device 412 is substantially the same as the conventional configuration. In the present embodiment, developing device 412 additionally includes, separately from toner concentration sensor 86, carrier detection sensor 87 that determines whether carrier is supplied from carrier supplying section 92.

As with toner concentration sensor 86, a permeability sensor that determines the permeability of the developer may be applied as carrier detection sensor 87, for example. Alternatively, an optical sensor may be applied as carrier detection sensor 87. Since it suffices that carrier detection sensor 87 can determine whether carrier is supplied, the detection accuracy of carrier detection sensor 87 may be lower than that of toner concentration sensor 86.

Carrier detection sensor 87 is disposed at a position near carrier supply port 81*b*, and at substantially the same level as the powder surface of the developer contained in developer container 81. Here, "position near carrier supply port 81*b*" means a region where the carrier supplied from carrier supplying section 92 is still not stirred with the developer in developer container 81, and, for example, is a region ranging from the position of carrier supply port 81*b* to a position on the immediately downstream of carrier supply port 81*b* with respect to the axis direction (in the case of FIG. 3, the region between carrier supply port 81*b* and toner supply port 81*a*). In addition, "the same level as the powder surface" means a position located at substantially the same level as the powder surface of the developer, or more specifically, the position is a position where the powder surface is within a detection region of carrier detection sensor 87. Preferably, when the screw size of stirring screw 82 is 20 mm, carrier detection sensor 87 has a detection width of about 8 mm, for example.

The carrier supplied from carrier supplying section 92 settles down from the powder surface of the developer; however, since carrier detection sensor 87 is disposed near the powder surface at which the carrier is supplied, the change in carrier concentration can be detected at that time. That is, the carrier concentration determined by carrier detection sensor 87 temporarily rises immediately after carrier is supplied from carrier supplying section 92, and returns back to the initial carrier concentration as the developer is conveyed to the downstream side in the conveyance direction while being stirred.

In this example, it is preferable to provide, at a position below carrier supply port 81*b*, a carrier retention section that limits the settling of the carrier supplied from carrier supplying section 92 (or slows down the settling speed). With this configuration, the carrier settles down at a slow speed in the developer, and thus a temporary change in carrier concentration can be surely detected by carrier detection sensor 87.

Figure 4:
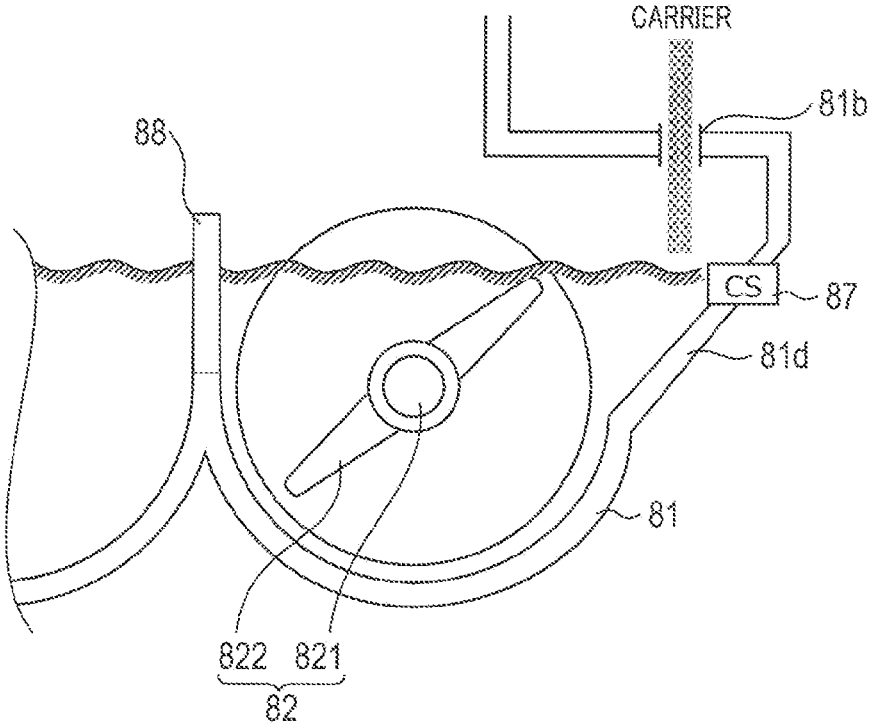
FIG. 4 illustrates an exemplary carrier retention section.
Figure 5:
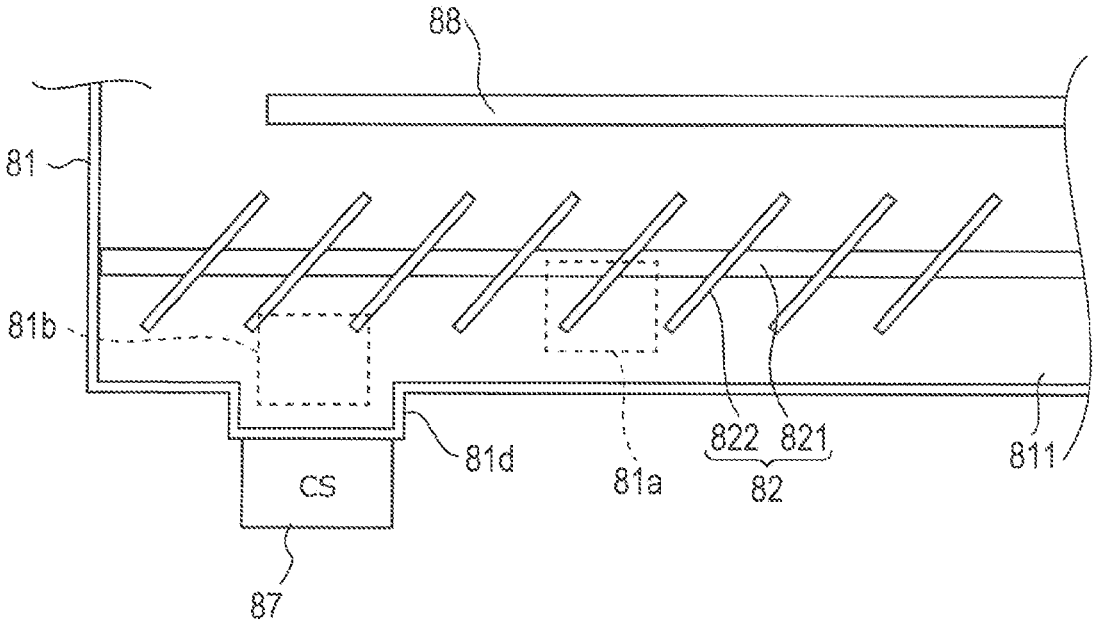
FIG. 5 illustrates an exemplary carrier retention section corresponding to FIG. 4.

For example, as illustrated in FIGS. 4 and 5, in a region below carrier supply port 81*b*, the wall surface of developer container 81 is inclined to the direction in which the carrier settles down. This inclined section 81*d* serves as the carrier retention section. With this configuration, the carrier supplied from carrier supplying section 92 settles down in the developer at a moderate speed along inclined section 81*d*, and thus a change in carrier concentration can be readily detected by carrier detection sensor 87.

Figure 6:
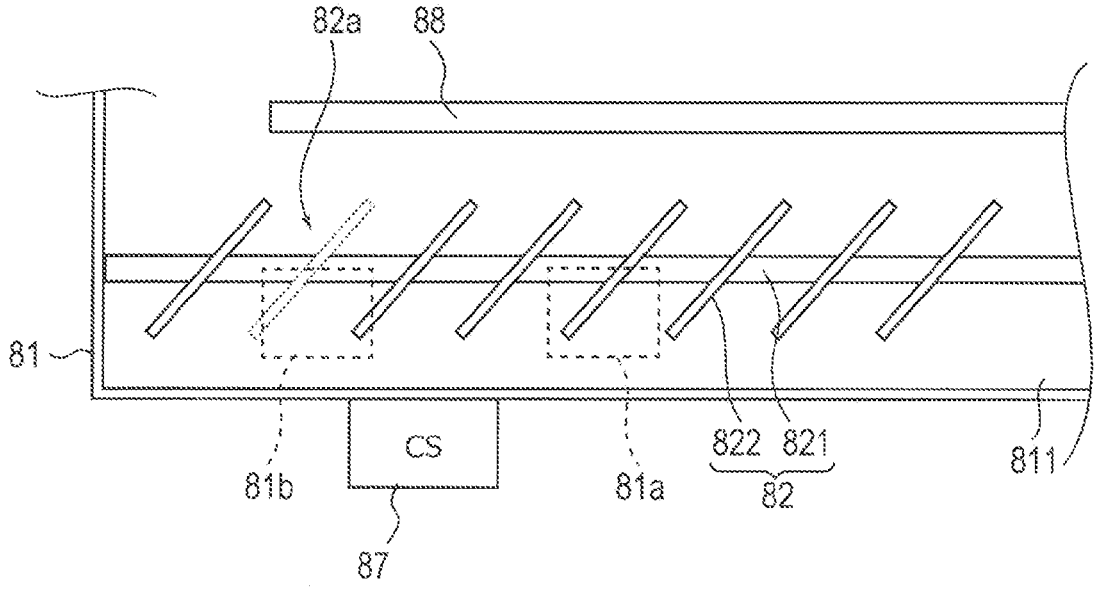
FIG. 6 illustrates another exemplary carrier retention section.

Alternatively, as illustrated in FIG. 6, vane 822 is not provided to stirring screw 82 in the region below carrier supply port 81*b*, for example. This part 82*a* provided with no vane serves as the carrier retention section. With this configuration, the stirring performance of stirring screw 82 decreases, and thus a change in carrier concentration can be readily detected by carrier detection sensor 87.

Figure 7:
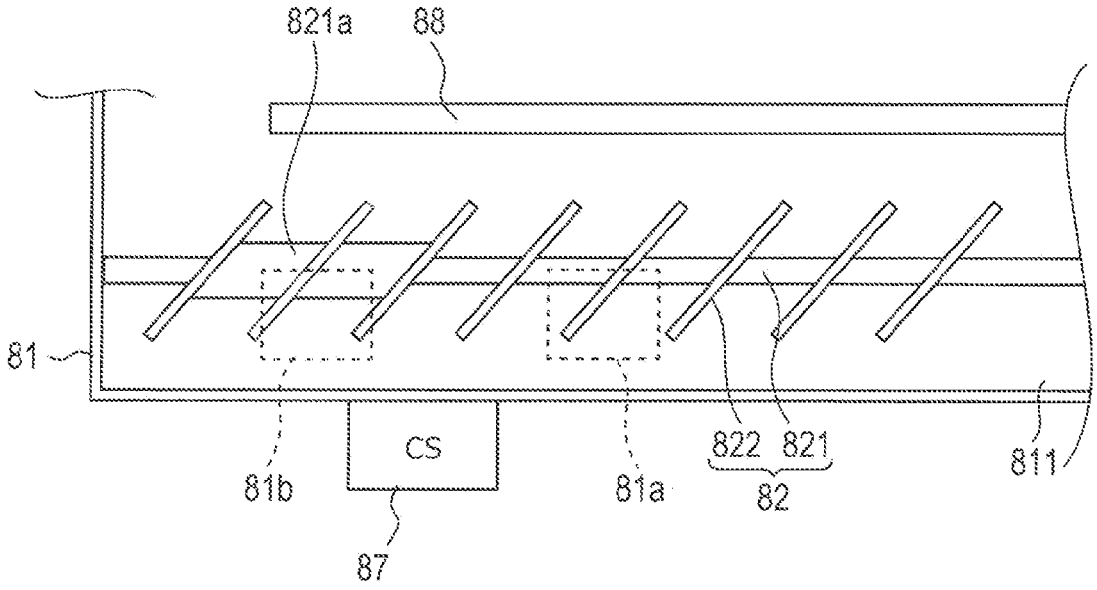
FIG. 7 illustrates still another exemplary carrier retention section.

Alternatively, as illustrated in FIG. 7, the outer diameter of shaft 821 of stirring screw 82 is increased than the other parts (large-diameter shaft part 821*a*) in the region below carrier supply port 81*b*, for example. This large-diameter shaft part 821*a* serves as the carrier retention section. With this configuration, the stirring performance of stirring screw 82 decreases, and thus a change in carrier concentration can be readily detected by carrier detection sensor 87.

Figure 8:
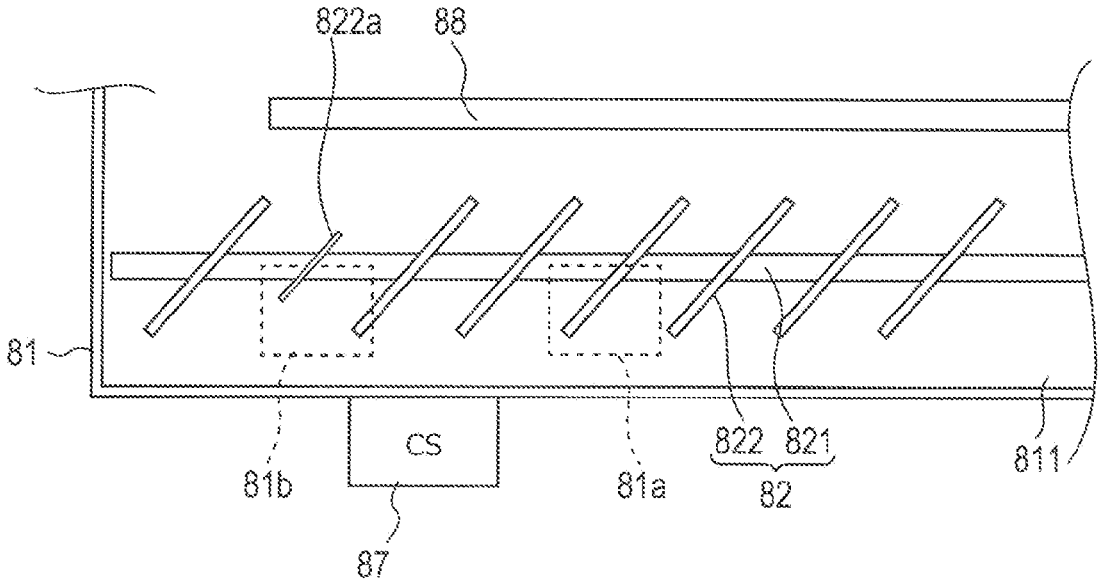
FIG. 8 illustrates still another exemplary carrier retention section.

Alternatively, as illustrated in FIG. 8, the outer diameter of vane 822 of stirring screw 82 is reduced than the other parts (small-diameter vane section 822*a*) in the region below carrier supply port 81*b*, for example. This small vane part 822*a* serves as the carrier retention section. With this configuration, the stirring performance of stirring screw 82 decreases, and thus a change in carrier concentration can be readily detected by carrier detection sensor 87.

Figure 9:
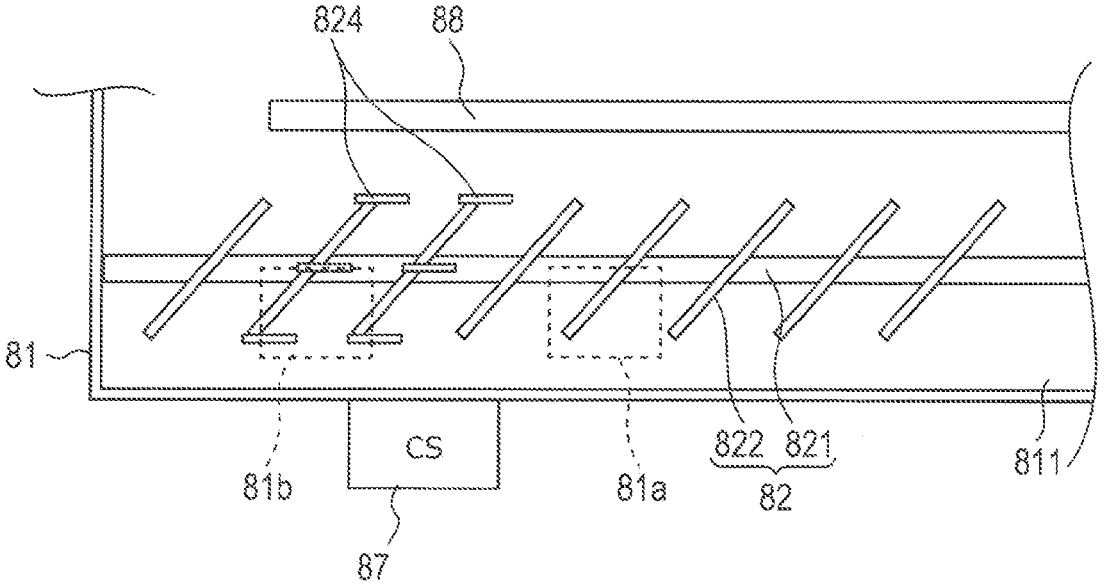
FIG. 9 illustrates still another exemplary carrier retention section.

Alternatively, as illustrated in FIG. 9, in the region below carrier supply port 81*b* of stirring screw 82, carrier catching part 824 that catches the settling carrier is provided to stirring screw 82. To be more specific, the end portion of vane 822 is bent to a side for catching the carrier, thereby forming carrier catching part 824. This carrier catching part 824 serves as the carrier retention section. With this configuration, the carrier supplied from carrier supplying section 92 is stirred against the settling direction and is temporarily retained in the detection region of carrier detection sensor 87. Thus, a change in carrier concentration can be readily detected by carrier detection sensor 87.

In a carrier supplying process for supplying carrier to developing device body 80, control section 100 monitors whether the carrier supplying operation has been performed on the basis of the output voltage value from carrier detection sensor 87. Specifically, the carrier supplying process is performed according to the flowchart illustrated in FIG. 10.

Figure 10:
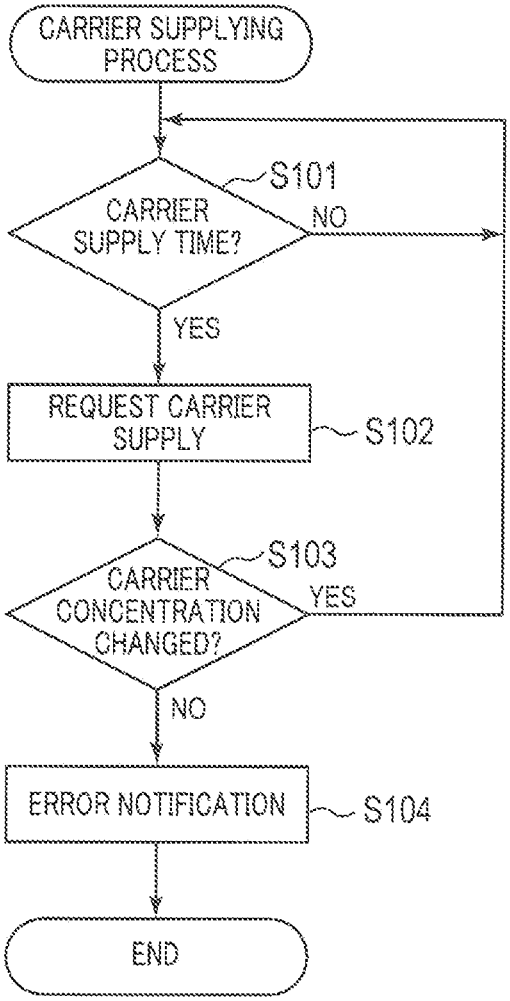
FIG. 10 is a flowchart of an exemplary carrier supplying process.

FIG. 10 is a flowchart illustrating an exemplary carrier supplying process. The carrier supplying process illustrated in FIG. 10 is implemented when CPU executes a given program stored in ROM at the time of starting an image formation, for example.

It is to be noted that control section 100 monitors the output voltage value from carrier detection sensor 87 at all times.

As illustrated in FIG. 10, first, at step S101, control section 100 determines whether it is a carrier supply time. The carrier supply time is set for every image formation processes for a predetermined number of sheets, or every time when developing device 412 has travelled a predetermined distance, for example. When control section 100 determines that it is the carrier supply time, the processing is advanced to step S102.

At step S102, control section 100 outputs a carrier supply signal to carrier supplying section 92, so as to supply a predetermined amount of carrier.

At step S103, on the basis of the output voltage value from carrier detection sensor 87, control section 100 determines whether the carrier supplying operation has been performed. To be more specific, on the basis of the change in output voltage value during a predetermined period after carrier supplying operation of step S102, control section 100 determines whether the carrier supplying operation has been performed. When control section 100 determines that the carrier supplying operation has been normally performed, the processing subsequent to step S101 is repeated. On the other hand, when control section 100 determines that the carrier supplying operation has not been normally performed, the processing is advanced to step S 104.

When carrier has been normally supplied, the carrier concentration temporarily increases in response to the carrier supplying operation. Accordingly, when the output voltage value from carrier detection sensor 87 has been changed, it is recognized that carrier has been practically supplied. On the other hand, when the output voltage value has not been changed even after the carrier supplying operation has been performed, it is recognized that no carrier has been practically supplied.

At step S104, control section 100 displays on the operation display section 20 an error message about a carrier-supply failure, and terminates the carrier supplying process. In the case where the error notification is performed, the carrier supply failure is cleared when the user (or service man) performs a maintenance relating to the carrier supply. After the maintenance is completed, the carrier supplying process is executed again.

It is also possible to, when control section 100 determines that the carrier supplying operation has not been normally performed at step S103, again perform the carrier supplying operation so as to determine whether the carrier supplying operation has been performed (steps S102 and S103).

As described above, developing device 412 according to the present embodiment includes: a developer container section (developer container 81) including toner supply port (81*a*), carrier supply port (81*b*), and developer outlet (81*c*), the developer container section being configured to contain therein a two-component developer composed of toner and magnetic carrier; a developer bearing member (developing roller 84) configured to supply the developer contained in the developer container section (developer container 81) to an image bearing member (photoconductor drum 413) on which an electrostatic latent image is formed; toner supplying section (91) configured to supply the toner to the developer container section (developer container 81) via the toner supply port (81*a*); carrier supplying section (92) provided separately from the toner supplying section (91), the carrier supplying section (92) being configured to supply the carrier to the developer container section (developer container 81) via the carrier supply port (81*b*); and a carrier detection section (carrier detection sensor 87) disposed at a position near carrier supply port (81*b*) and at a same level as a powder surface of the developer contained in the developer container section (developer container 81), the carrier detection section (carrier detection sensor 87) being configured to detect carrier supplied from the carrier supplying section (92).

According to developing device 412, the carrier supplied from carrier supplying section 92 and the toner are still not stirred in the region where carrier detection sensor 87 is disposed, and thus a change in carrier concentration caused by the carrier supplying operation can be surely detected. In addition, since the maintenance relating to the carrier supply can be requested when the carrier supplying operation has not been normally performed, the carrier supply failure can be cleared immediately. Consequently, it is possible to prevent the degradation in image quality due to factors such as fogging and toner scattering which are caused by the carrier supply failure.

EXAMPLE

In the Example, image forming apparatus 1 according to the embodiment was used to sequentially form images each having an A4 size and a coverage of 5%, and the carrier supplying operation was performed every time when the image was formed on 1000 sheets. In addition, the toner supplying operation was appropriately controlled such that the toner concentration is 7 wt %.

Figure 11:
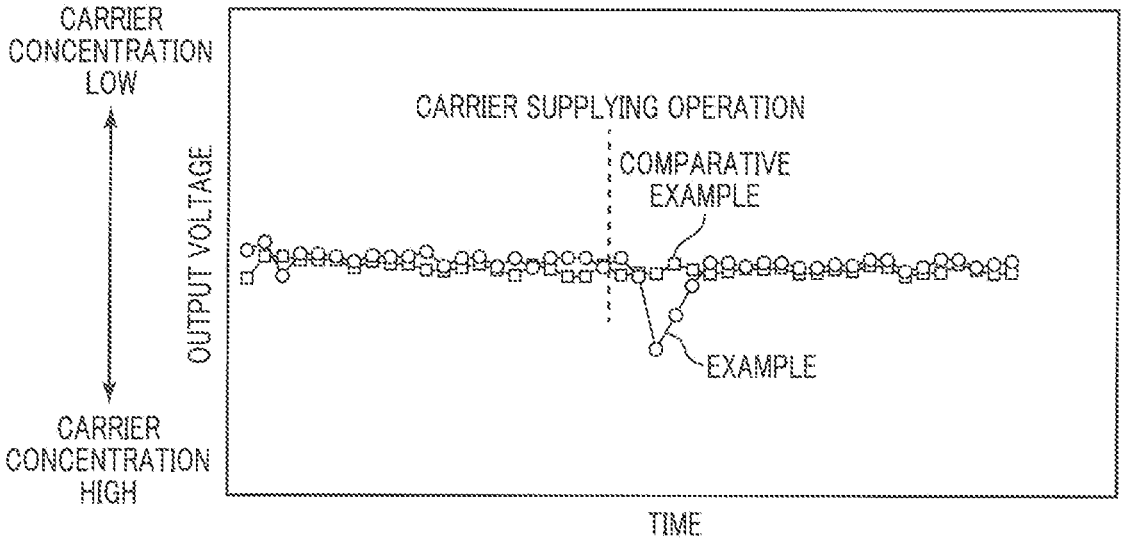
FIG. 11 illustrates changes in carrier concentration at the time of supplying carrier.

FIG. 11 shows results of the detection obtained by carrier detection sensor 87 at the time of supplying carrier, in other words, changes in carrier concentration. As shown in FIG. 11, the change in carrier concentration which temporarily increases after the carrier supplying operation was detected by carrier detection sensor 87.

On the other hand, FIG. 11 shows, as a comparative example, results of the detection obtained by toner concentration sensor 86 at the time of supplying carrier. Although the carrier concentration of the developer in developer container 81 can be determined also by toner concentration sensor 86, the change in carrier concentration at the time of supplying carrier could not be detected, as illustrated in FIG. 11.

In addition, although not shown in FIG. 11, when the carrier supplying operation has not been normally performed in Example, no change in carrier concentration was detected, as in Comparative Example. That is, by monitoring the change in carrier concentration after the carrier supplying operation, whether the carrier supplying operation has been normally performed can be surely determined.

From the results of Example and Comparative Example, the effectiveness of disposing carrier detection sensor 87 near carrier supply port 81*b* was confirmed.

While the invention made by the present inventor has been specifically described based on the preferred embodiments, it is not intended to limit the present invention to the above-mentioned preferred embodiments but the present invention may be further modified within the scope and spirit of the invention defined by the appended claims.

Figure 12:
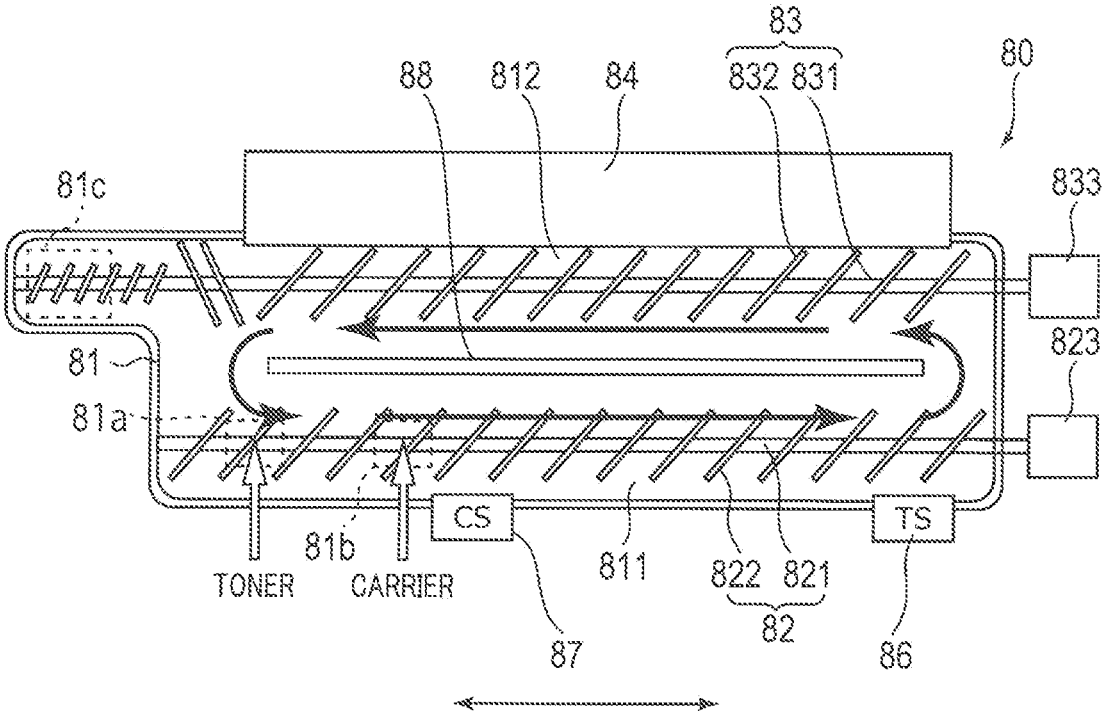
FIG. 12 illustrates another exemplary mode of disposing a toner supply port and a carrier supply port.

For example, as illustrated in FIG. 12, in developer container 81, carrier supply port 81*b* may be disposed on the downstream side in the developer conveyance direction relative to toner supply port 81*a*. Also in this case, carrier detection sensor 87 is disposed at a position near carrier supply port 81*b*, and at substantially the same level as the powder surface of the developer contained in developer container 81. It should be noted, however, that when the carrier retention sections illustrated in FIGS. 4 to 9 are provided near carrier supply port 81*b*, the stirring performance for the toner supplied from toner supply port 81*a* may be degraded. In other words, from the viewpoint of the stirring performance for toner, carrier supply port 81*b* is preferably disposed on the upstream side in the developer conveyance direction relative to toner supply port 81*a*, as illustrated in FIG. 3.

Figure 13:
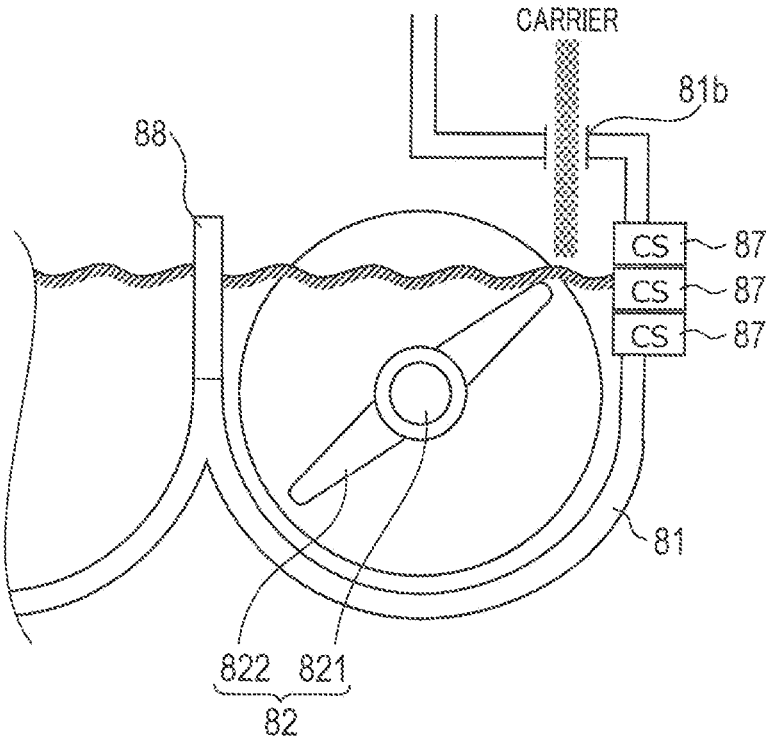
FIG. 13 illustrates another exemplary mode of disposing a carrier detection sensor.
Figure 14:
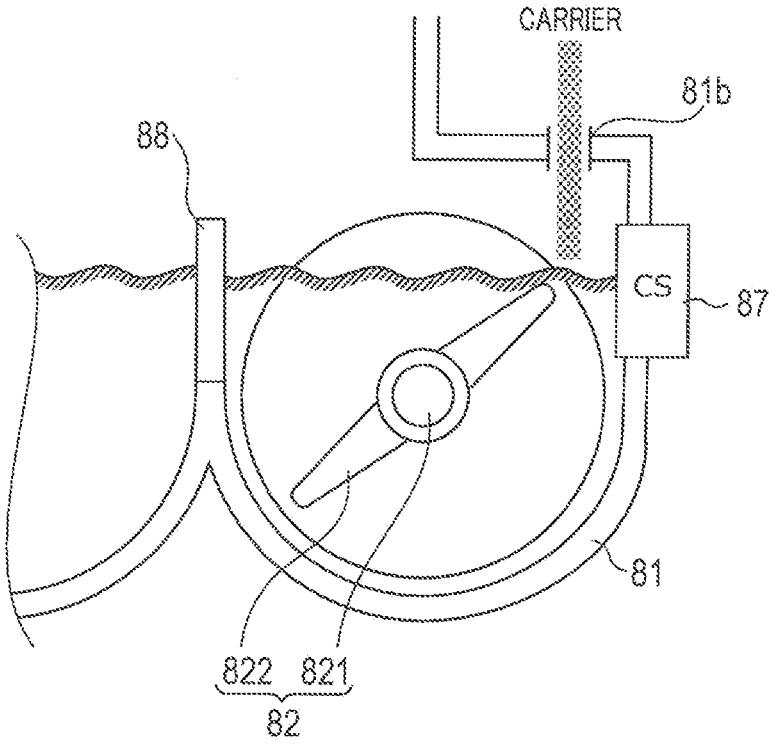
FIG. 14 illustrates another exemplary mode of disposing the carrier detection sensor.

In addition, for example, as in FIG. 13, multiple carrier detection sensors 87 may be disposed along the direction in which carrier settles down, and it is preferable to adopt a sensor which has a detection width which is wide in the direction in which carrier settles down. With this configuration, even when the powder surface of the developer is changed, the change in carrier concentration at the time of supplying carrier can be detected, thus increasing the detection accuracy.

The embodiment disclosed herein is merely an exemplification and should not be considered as limitative. The scope of the present invention is specified by the following claims, not by the above-mentioned description. It should be understood that various modifications, combinations, sub-combinations and alterations may occur depending on design requirements and other factors in so far as they are within the scope of the appended claims or the equivalents thereof.

What is claimed is:

1. A developing device comprising:

a developer container section including a toner supply port, a carrier supply port, and a developer outlet, the developer container section being configured to contain therein a two-component developer composed of toner and magnetic carrier;

a developer bearing member configured to supply the developer contained in the developer container section to an image bearing member on which an electrostatic latent image is formed;

a toner supplying section configured to supply the toner to the developer container section via the toner supply port;

a carrier supplying section provided separately from the toner supplying section, the carrier supplying section being configured to supply the carrier to the developer container section via the carrier supply port; and a carrier detection section disposed at a position near the carrier supply port and at a same level as a powder surface of the developer contained in the developer container section, the carrier detection section being configured to detect carrier supplied from the carrier supplying section.

2. The developing device according to claim 1, wherein the developer container section includes a developer supplying path and a developer stirring path, the developer supplying path being configured to be in parallel to an axis direction of the developer bearing member, and to supply the developer to the developer bearing member while conveying the developer, the developer stirring path being configured to be in juxtaposition with the developer supplying path and in communication with the developer supplying path at both end portions thereof in an axis direction, and to stir the developer while conveying the developer in a direction opposite to the direction of the developer supplying path, and the carrier supply port is disposed on an upstream side relative to the toner supply port in a direction in which the developer is conveyed in the developer stirring path.

3. The developing device according to claim 1, wherein the developer container section includes a developer supplying path and a developer stirring path, the developer supplying path being configured to be in parallel to an axis direction of the developer bearing member, and to supply the developer to the developer bearing member while conveying the developer, the developer stirring path being configured to be in juxtaposition with the developer supplying path and in communication with the developer supplying path at both end portions thereof in an axis direction, and to stir the developer while conveying the developer in a direction opposite to the direction of the developer supplying path, and the carrier supply port is disposed on a downstream side relative to the toner supply port in a direction in which the developer is conveyed in the developer stirring path.

4. The developing device according to claim 1 further comprising a carrier retention section provided in a region below the carrier supply port of the developer container section, the carrier retention section being configured to limit settling of carrier supplied from the carrier supplying section.

5. The developing device according to claim 4, wherein the developer container section includes, as the carrier retention section, a part which is inclined to a direction in which the carrier settles down.

6. The developing device according to claim 4 further comprising, in the developer container section, a stirring screw provided with a vane spirally formed on a shaft, the stirring screw being configured to convey the developer while stirring the developer, wherein the stirring screw includes, as the carrier retention section, a part where the vane is not provided.

7. The developing device according to claim 4 further comprising, in the developer container section, a stirring screw provided with a vane spirally formed on a shaft, the stirring screw being configured to convey the developer while stirring the developer, wherein the shaft includes, as the carrier retention section, a large-diameter shaft part having a diameter larger than a diameter of the other parts.

8. The developing device according to claim 4 further comprising, in the developer container section, a stirring screw provided with a vane spirally formed on a shaft, the stirring screw being configured to convey the developer while stirring the developer, wherein the vane includes, as the carrier retention section, a small vane part where the vane has a diameter smaller than a diameter of the vane of the other parts.

9. The developing device according to claim 4 further comprising, in the developer container section, a stirring screw provided with a vane spirally formed on a shaft, the stirring screw being configured to convey the developer while stirring the developer, wherein the vane includes, as the carrier retention section, a carrier catching part configured to catch settling carrier.

10. The developing device according to claim 1, wherein the carrier detection section includes a plurality of carrier detection sections, and the plurality of carrier detection sections are arranged along a direction in which carrier settles down.

11. The developing device according to claim 1, wherein the carrier detection section determines a carrier concentration on the basis of a permeability of the developer.

12. An image forming apparatus comprising the developing device according to claim 1, wherein the developing device forms a toner image on the image bearing member, and, after the toner image thus formed is transferred to a sheet, fixing is performed to form an image.

* * * * *